United States Patent [19]

Pimlott

[11] Patent Number: 4,561,959

[45] Date of Patent: Dec. 31, 1985

[54] FLAT-PLATE ELECTROLYTIC CELL

[75] Inventor: John R. Pimlott, Sweeny, Tex.

[73] Assignee: The Dow Chemical Company, Midland, Mich.

[21] Appl. No.: 559,660

[22] Filed: Dec. 9, 1983

[51] Int. Cl.[4] ..... C25B 9/04; C25B 11/03

[52] U.S. Cl. ..... 204/253; 204/279; 204/282; 204/283; 204/288

[58] Field of Search ..... 204/81, 254, 268, 286, 204/288, 289, 297 R, 283, 282, 253, 279

[56] References Cited

U.S. PATENT DOCUMENTS

| | | | |
|---|---|---|---|
| 3,873,437 | 3/1975 | Pulver | 204/254 |
| 4,033,849 | 7/1977 | Pohto et al. | 204/286 |
| 4,080,279 | 3/1978 | Poush et al. | 204/252 |
| 4,279,731 | 7/1981 | Pellegri | 204/254 |
| 4,341,604 | 7/1982 | De Nora et al. | 204/283 X |
| 4,343,689 | 8/1982 | De Nora et al. | 204/283 X |
| 4,374,014 | 2/1983 | Smith et al. | 204/260 |
| 4,409,074 | 10/1983 | Iijima et al. | 204/263 X |
| 4,440,615 | 4/1984 | Pere | 204/283 X |
| 4,444,639 | 4/1984 | Schurig et al. | 204/282 |

FOREIGN PATENT DOCUMENTS

| | | | |
|---|---|---|---|
| 2,448,582 | 10/1980 | France | 204/254 |

*Primary Examiner*—Donald R. Valentine

*Attorney, Agent, or Firm*—Robert W. Selby

[57] ABSTRACT

The invention relates to an ion exchange-type electrolytic cell with electrodes retained in close proximity to each other by means of a spring element.

11 Claims, 2 Drawing Figures

Fig. 1
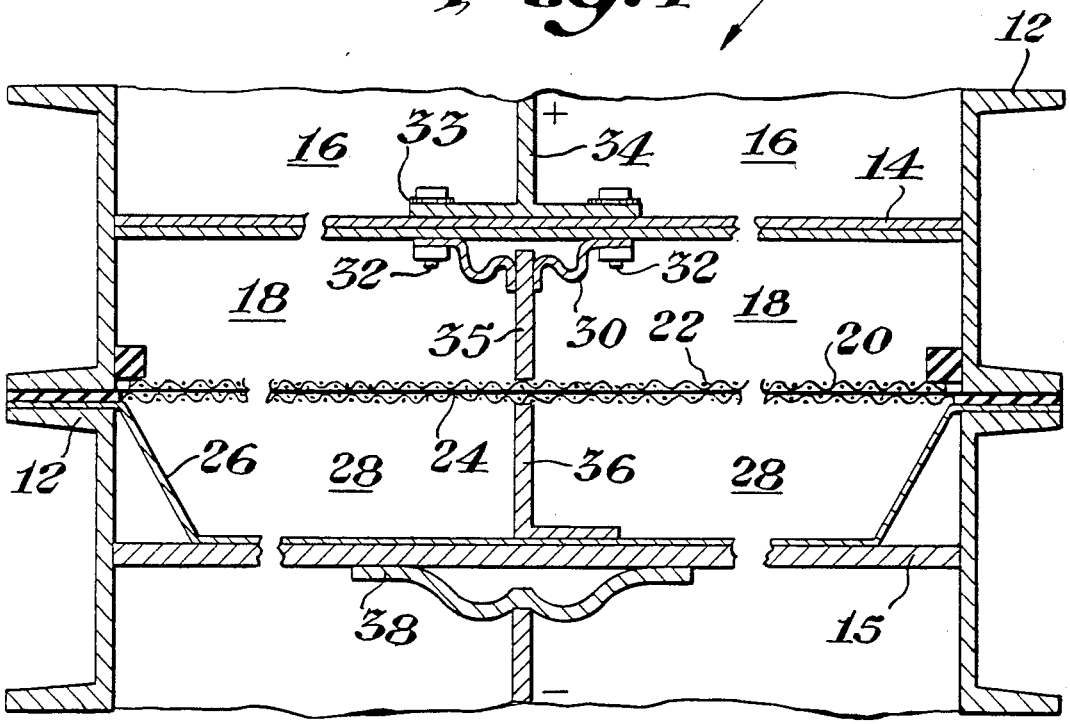
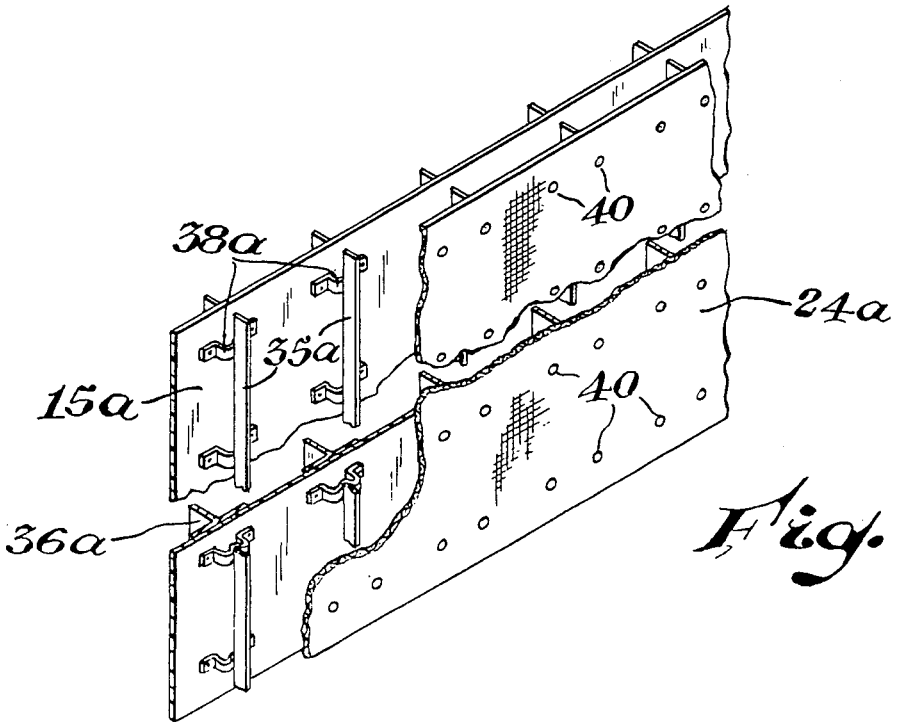
Fig. 2

FLAT-PLATE ELECTROLYTIC CELL

BACKGROUND OF THE INVENTION

This invention pertains to an electrolytic cell and more in particular to an improved means to reduce the inter-electrode distance in an electrolytic cell.

Gaseous chlorine has long been produced from an aqueous solution or slurry containing an alkali metal chloride, such as sodium chloride, in an electrolytic cell having an anode positioned within an anode compartment and a cathode in a cathode compartment spaced apart from the anode compartment by an ion and liquid permeable diaphragm. In recent years, cation exchange membranes have been developed which permit the passage of positively charged ions from the anode compartment to the cathode compartment without allowing substantial quantities of negatively charged ions and water to pass from the cathode compartment to the anode compartment. In both the electrolytic diaphragm and membrane type cells chlorine is released at the anode and alkali metal hydroxide, such as sodium hydroxide, is formed in the cathode compartment.

It has become apparent that the use of the cation exchange membrane type cells may be preferable to the diaphragm cell in instances where a higher purity, for example a lower sodium chloride content, sodium hydroxide product is desired. It has also been found to be more convenient to fabricate the membrane type electrolytic cells from relatively flat or planar sheets of ion exchange membrane rather than to interweave the membrane between the anode and cathode within the older diaphragm cells, which had anodes interposed between cathodes in a finger-like arrangement.

The newer, so-called flat-plate bipolar electrolytic cells using a planar piece of ion exchange membrane to separate the anolyte from the catholyte compartments are similar to the diaphragm cells insofar as there is a common attempt to minimize the distance between the anode and the cathode. A minimum electrode spacing is desired so that the electrical resistance between electrodes will be reduced and the cell efficiency improved.

There have been several attempts to reduce the inter-electrode spacing in the flat-plate electrolytic cell. It is, however, desired to provide a relatively uncomplicated, readily useable means to retain the electrodes in an ion exchange membrane cell in close proximity to each other.

SUMMARY OF THE INVENTION

The present invention, which accomplishes the above objects, is an improved electrolytic cell adapted to produce chlorine and an alkali metal hydroxide from an aqueous alkali metal chloride containing brine. The cell includes at least two ion and liquid impermeable backplates with first and second surface portions, which partially define at least two electrode compartments. The cell further includes within the electrode compartments substantially planar ion permeable electrodes spaced apart by, and in contact with, a cation exchange membrane.

The particular improvement in this cell is the inclusion of a plurality of expansible, electric conducting spring elements secured to the first surface portion of the backplate and to an electric conducting rigid element secured to one electrode. A rigid, electric conducting pressure receiving means is secured to a second electrode and to the second surface portion of the backplate facing the spring elements. The spring elements are adapted to cooperatively act with the pressure receiving means to exert a force on the electrodes, and the membrane interposed between the electrodes, sufficient to retain the electrodes in close proximity with each other.

DESCRIPTION OF THE DRAWING

The accompanying drawing further illustrates the invention.

In FIG. 1 is depicted a cross-sectional top view of one embodiment of the invention.

In FIG. 2 is an isometric view of a portion of an electrolytic cell backplate member with spring elements attached thereto.

Identical numbers, distinguished by a letter suffix, within the several figures represent parts having a similar function within the different embodiments.

DESCRIPTION OF THE PEFERRED EMBODIMENTS

Referring now to FIG. 1 of the drawing, electrolytic cell section 10 is a portion of a bipolar electrolytic cell series containing a plurality of cell sections. Included within this cell section is a cell frame 12 adapted to contain the various cell elements, electrolyte and electrolytic products. Cell barriers 14 and 15 at least partially define electrode compartments, such as anode compartment 16 and cathode compartment 18. All electrode compartments, whether containing an anode or a cathode, are further defined by an ion exchange membrane 20, which is interposed between a cathode 22 and an anode 24.

The barriers 14 and 15 can be made of an electric conducting or an electric insulating material. The barrier 14 is a bilayer electric insulating material resistant to the anolyte on one surface and the catholyte on the opposite surface. When the barrier is resistant to all of the electrolyte, i.e., anolyte and catholyte, the barrier may be constructed of a single material and define a portion of the electrolyte compartments. When, as with the electric conducting barrier 15, the barrier is not resistant to the anolyte, an anolyte resistant cover or pan 26 is preferably utilized to cover the barrier and protect the barrier from corrosion. In the present discussion, the cover 26 is defined as being part of the barrier. Accordingly, anode compartment 28 is partially defined by the anolyte resistant cover portion 26 of the barrier 15.

The cell barriers 14 and 15 are adapted to divide an electrolytic cell series into a number of compartments without permitting subtantial quantities of the anolyte or catholyte flowing into the adjacent compartment through or around the barriers. As aforementioned, the barriers can be constructed from electric conducting or insulation materials. Examples of such materials are film forming or valve metals, including tantalum, titanium, and tungsten; iron, including steel and stainless steel; nickel and nickel alloys; acrylonitrile, butadiene and styrene copolymers; epoxies; fluoroplastics; polypropylene; polyvinyl chloride; chlorinated polyvinylchloride; and poly and vinyl esters.

The ion exchange membrane 20 is so positioned in the electrolytic cell between the anode 24 and the cathode 22 to prevent leakage of substantial quantities of electrolyte from one compartment to the other. In a preferred embodiment, there is substantially no leakage of electrolyte between the anode and cathode compartments. Since the electrolytic cell of the present invention is adapted to produce chlorine and various alkali metal hydroxide solutions from an aqueous brine containing an alkali metal chloride, preferably sodium chloride, the ion exchange membrane is preferably of the cation type. Cation exchange membranes are well-known to contain fixed ionic groups that permit intrusion and exchange of cations, and exclude anions, from an external source. Generally the resinous membrane has as a matrix a crosslinked polymer, to which are attached charged radicals such as $—SO_3^{31}$, $—COO^-$, $—PO_3^=$, $—HPO_2^-$, $—AsO_3^=$ and $—SeO_3^-$. Vinyl addition polymers and condensation polymers may be employed. The polymer can be, for example, styrene, divinylbenzene, polyethylene and fluorocarbons. Condensation polymers are, for example, phenol sulfuric acid and formaldehyde resins. Examples of such cation exchange membranes are shown in U.S. Pat. Nos. 3,909,378; 4,270,996; 4,330,654; 4,337,137; 4,337,211; 4,340,680; and 4,358,547.

The anode 24 is a metal, such as one of the common film-forming metals resistant to the corrosive effects of the anolyte during operation of the cell. Suitable materials are well known to include molybdenum, niobium, titanium, tantalum, tungsten and zirconium coated with an activating substance, such as an oxide of a platinum group metal including, for example, ruthenium, iridium, rhodium, platinum, and palladium, either alone or in combination with an oxide of a film-forming metal. Other suitable activating oxides include cobalt oxide, either alone or in combination with other metal oxides. Examples of such activating oxides are found in U.S. Pat. Nos. 4,061,549; 4,366,042; and 4,369,105.

The cathode 22 is electrically connected through the barrier 14 to an anode (not shown) and the anode compartment 16 to form a bipolar element suitable for use in a stacked arrangement within the electrolytic cell frame or container 12. The cathode 22 is constructed of a material resistant to the corrosive effects of the catholyte during operation of the cell. Materials suitable for contact with the catholyte will depend upon the concentration of the alkali metal hydroxide in the aqueous solutin and may be readily determined by one skilled in the art. Generally, however, materials such as iron, and nickel, and alloys including major amounts of these metals, such as steel and stainless steel, are suitable for use as the cathode.

Both the anode and the cathode are permeable to the respective electrolytes and any gas produced or formed at the electrode. The electrodes can be made permeable by several means including, for example, using a punched sheet or plate, expanded mesh, or woven wire. The anode should be sufficiently porous to permit anolyte and chlorine to pass therethrough and the cathode should be sufficiently porous to permit sodium ions, catholyte, and, optionally, hydrogen, to pass therethrough. In one embodiment at least one electrode is bonded directly to the membrane.

A spring element 30 is abuttingly attached to the barrier 14 by connecting means, such as bolts 32 which extend through the barrier, and to an electric conducting pressure receiving means 34 positioned within the anode compartment 16. Suitable gaskets or other seals 33 may be placed around the bolts 32 to minimize, and preferably, substantially entirely prevent leakage of electrolyte between the cathode compartment 18 and the anode compartment 16.

The spring element 30 is physically attached to a rigid, electric conducting element 35 by means suitable to maintain both a physical and electrical bond between the spring 30 and the electric conducting element 35. Such means can include, for example, bolting or welding at the points the two components meet. The electric conducting element 35 is secured to the cathode 22 by, for example, welding, riviting or bolting and preferably capacitance discharge welding.

In the anode compartment 28 a rigid, electric conducting pressure receiving means 36 is electrically and physically connected to both the anode 24 and the electrolyte resistant cover portion 26 of the barrier 15. In FIG. 1, the connections to the cover portion 26 and the anode 24 are made by welding; however, the connections can also be made by, for example, riviting or bolting and preferably capacitance discharge resistance welding.

The specific configuration of the spring element 30 is not critical to the present invention so long as the spring is of sufficient strength to hold the cathode 22, the membrane 20 and the anode 24 together and against the anode pressure receiving means or post 36 without deleteriously deforming or puncturing the ion exchange membrane 20. A second spring element 38 welded to the barrier 15 is illustrative of another configuration of the spring. The springs 30 and 38 and the pressure receiving means 34 and 36 can be of various shapes and constructed of various materials as long as the material selected is resistant to the corrosive effects of the electrolyte in which the material is placed. Materials suitable for use in the anolyte are, for example, niobium, molybdenum, tantalum, titanium, tungsten and zirconium. Materials suitable for use in the catholyte are, for example, copper, nickel and nickel alloys, steel and stainless steel.

In FIG. 2 is shown a partial, elevation view of a cell barrier 15*a* with a plurality of spring members 38*a* bolted to the barrier. Generally upstanding, rigid electric conducting elements 35*a* are physically and electrically connected to both the spring members 38*a* and an anode 24*a*. Holes 40, defined by the anode 24*a*, extend through the anode to afford ready access to the bolts restraining the spring members 38*a* during assembly and disassembly. The spring members 38*a* are electrically connected through the cell barrier to a plurality of generally upstanding, rigid pressure receiving means 36*a*. The pressure receiving means 36*a* are physically and electrically connected to a cathode (not shown). A plurality of the cell barriers of FIG. 2 may be assembled in a stacked series in a manner substantially the same as described in FIG. 1.

As is apparent from the foregoing specification, the apparatus of the present invention is susceptible of being embodied with various alterations and modifications, which may differ from those described in the preceding description. For this reason, it is to be fully understood that all of the foregoing is intended to be illustrative and not to be construed or interpreted as being restrictive or otherwise limiting the present invention.

What is claimed is:

1. In an electrolytic cell adapted to produce chlorine and an alkali metal hydroxide from an aqueous alkali metal chloride containing brine, the cell including at least two ion and liquid impermeable backplates with first and second surface portions partially defining at least two electrode compartments with substantially planar ion permeable electrodes within the electrode compartments spaced apart by, and contacting, a cation exchange membrane, the improvement comprising:

a plurality of expansible, electric conducting spring elements secured to the first surface portion of the backplate and to a rigid, electric conducting element secured to one electrode, and a rigid, electric conducting pressure receiving means secured to a second electrode and to the second surface portion of the backplate facing the spring elements, the spring elements cooperatively acting with the pressure receiving means to exert a force on the electrodes, and the membrane interposed between the electrodes, sufficient to retain the electrodes in close proximity with each other.

2. The cell of claim 1 wherein the backplates are electric conductors.

3. The cell of claim 1 wherein the backplates are electric insulators and the spring elements and pressure receiving means are secured to the backplates by electric conducting connectors extending through the backplates.

4. The cell of claim 1 wherein the electrodes are liquid and gas permeable.

5. The cell of claim 4 wherein the electrodes are metal sheet with holes therein.

6. The cell of claim 1 wherein the spring elements are welded to the rigid elements and the rigid elements are welded to the electrode.

7. The cell of claim 1 wherein the pressure receiving means is welded to the electrode.

8. The cell of claim 1 wherein at least one of the electrodes is bonded to the membrane.

9. The cell of claim 1 wherein the rigid pressure receiving means are generally upstanding, elongated members extending outwardly from the backplate spacing apart the pressure receiving means and spring elements electrically connected to the receiving means.

10. The cell of claim 9 wherein the rigid electric conducting elements are generally upstanding, elongated members extending outwardly from spring elements and the backplate.

11. The cell of claim 1 wherein the spring elements and pressure receiving means are connected by bolts extending through the backplate and an electrode has holes therein suited to provide access to the bolts.

* * * * *